US009956788B2

(12) United States Patent
Padilla

(10) Patent No.: US 9,956,788 B2
(45) Date of Patent: May 1, 2018

(54) DEVICES AND METHODS FOR PRINTING ON BOARDS

(71) Applicant: Stitch City Industries, Santa Fe Springs, CA (US)

(72) Inventor: Fernando Padilla, La Mirada, CA (US)

(73) Assignee: Stitch City Industries, Santa Fe Springs, CA (US)

( * ) Notice: Subject to any disclaimer, the term of this patent is extended or adjusted under 35 U.S.C. 154(b) by 0 days. days.

(21) Appl. No.: 14/950,207

(22) Filed: Nov. 24, 2015

(65) Prior Publication Data

US 2017/0144452 A1 May 25, 2017

(51) Int. Cl.

| | |
|---|---|
| ***B41J 3/407*** | (2006.01) |
| ***A63C 17/26*** | (2006.01) |
| ***A63C 5/00*** | (2006.01) |
| ***A63C 17/01*** | (2006.01) |

(52) U.S. Cl.

CPC ..... *B41J 3/4073* (2013.01); *A63C 5/003* (2013.01); *A63C 17/26* (2013.01); *A63C 17/01* (2013.01); *A63C 2203/08* (2013.01); *A63C 2203/42* (2013.01)

(58) Field of Classification Search

CPC ..... B41J 3/4073; B41J 2/01; B63B 35/7906; A63C 17/26

See application file for complete search history.

(56) References Cited

U.S. PATENT DOCUMENTS

| | | | | |
|---|---|---|---|---|
| 6,126,747 | A | 10/2000 | Fitzburgh | |
| 6,237,486 | B1 * | 5/2001 | Firth | B41F 15/0895 101/123 |
| 8,090,461 | B2 | 1/2012 | Ohiaeri et al. | |
| 8,568,829 | B2 | 10/2013 | Padilla | |
| 8,654,120 | B2 | 2/2014 | Beaver, III et al. | |
| 2013/0014330 | A1 * | 1/2013 | Romero | A43D 5/02 12/123 |

FOREIGN PATENT DOCUMENTS

WO 2010069930 A1 6/2010

OTHER PUBLICATIONS

Omni Skateboards Australia, Artwork Submission Details and Requirements, www.omnisk8.com.au/printing.html.

Point Distribution, Skateboard Printing 101, http://pointdistribution.com/skateboard-printing-101.

Alibaba, New Generation Flat UV Leg Skateboard Printing Machine, www.alibaba.com/product-detail/new-generation-flat-UV-Led-skateboard_1705575919.html?spm=a2700.7724857.35.1.dYidsb&s=p.

* cited by examiner

*Primary Examiner* — Bradley Thies

(57) ABSTRACT

A device of the present disclosure has a board reception plate coupled on a first side to a first side plate and coupled on a second side to a second side plate, and the board reception plate is adapted for supporting a board. The apparatus further has a first spring-loaded sliding bar coupled to the first side plate that has a first channel for receiving a first edge of the board and a second spring-loaded sliding bar coupled to the second side plate that has a second channel for receiving a second edge of the board.

10 Claims, 4 Drawing Sheets

DEVICES AND METHODS FOR PRINTING ON BOARDS

BACKGROUND

An inkjet printer recreates a digital image on an article, e.g., paper, by spraying droplets of ink. The process is relatively simple. A software application sends data to be printed to the inkjet printer driver, which translates the data into a printer-friendly format. The translated data is sent to the inkjet printer. The inkjet printer moves the article on which the digital image is being recreated as the inkjet printer sprays dots of ink on the article.

Inkjet printers may be used to print graphics on articles of clothing, such as shirts. Printing on some articles, e.g., shirts, is a relatively simple process due to the flat nature of the article of clothing. Notably, articles of clothing are effectively one-dimensional and may be easily laid on a flat surface so that graphics can be printed on the clothing.

However, this is not the case when printing on three-dimensional articles. As an example, it is difficult to apply graphics to three-dimensional boards, such as skateboards, snowboards, and surfboards. In this regard, the width of a three-dimensional board makes the board difficult to retain and secure relative to a printing apparatus as graphics are being applied. Also, the printing surfaces of the board may be contoured and have a variety of different shapes.

SUMMARY

The present disclosure describes devices and methods for printing on articles. An apparatus for printing on articles in accordance with an embodiment of the present disclosure may be used with a printer to print on, for example, skateboards, snowboards, surfboards, and/or the like, regardless of the article's size.

A device in accordance with an exemplary embodiment of the present disclosure has a board reception plate coupled on a first side to a first side plate and coupled on a second side to a second side plate, and the board reception plate is adapted for supporting a board. Further, the device has a first spring-loaded sliding bar coupled to the first side plate that has a first channel for receiving a first edge of the board and a second spring-loaded sliding bar coupled to the second side plate that has a second channel for receiving a second edge of the board.

A method in accordance with an embodiment of the present disclosure may be embodied in the following steps: a. providing a board platen that has (1) a board reception plate coupled on a first side to a first side plate and coupled on a second side to a second side plate, which is adapted for supporting a board; (2) a first spring-loaded sliding bar coupled to the first side plate and having a first channel for receiving a first edge of the board; and (3) a second spring-loaded sliding bar coupled to the second side plate and having a second channel for receiving a second edge of the board; b. inserting a first edge of a board into the first channel; c. inserting a second edge of the board into the second channel; and d. printing a customized graphic on an exposed surface of the board.

BRIEF DESCRIPTION OF THE DRAWINGS

The present disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure describes devices and methods for printing graphics on different types of boards. Exemplary types of boards for which the device may be used include skateboards, snowboards, surfboards, and the like. Other embodiments of the system may be used to print graphics on other types and sizes of boards. The following disclosure is not intended to be limited to a particular type or size of boards.

Figure 1:
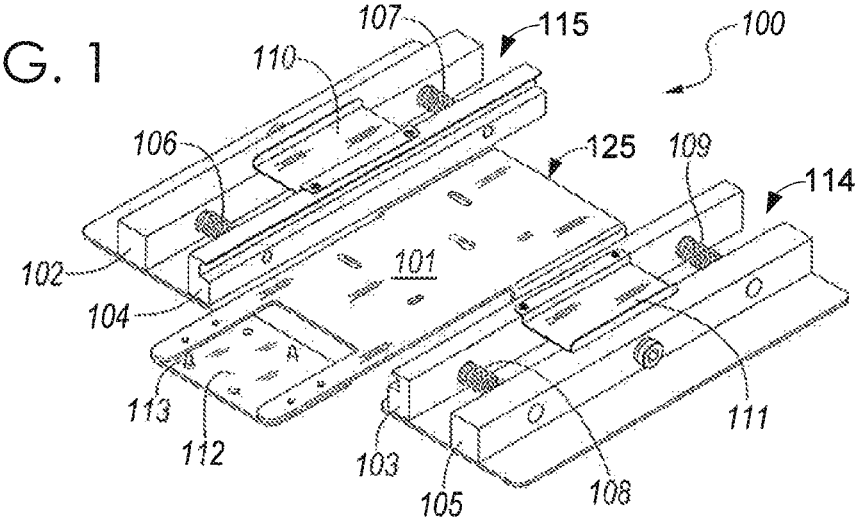
FIG. 1 is a top perspective view of an exemplary board platen in accordance with an embodiment of the present disclosure.

FIG. 1 depicts an exemplary platen 100 in accordance with an embodiment of the present disclosure. The board platen 100 comprises a board support plate 101. The board support plate 101 comprises a board reception plate 125 and two side plates 114 and 115.

The board reception plate 125 comprises a size extension plate 112, which is slidably coupled to a front end of the board reception plate 125. The sliding feature of the size extension plate 112 is described further with reference to FIG. 2. The size extension plate 112 slides bidirectionally as indicated by reference arrow 124. The described bidirectional movement of the size extension plate 112 allows for support and accommodation of different sizes of boards. In this regard, when the size extension plate 112 is slid outward, this outward extension causes an increase in a length of the board reception plate 125 so that the board reception plate 125 may receive boards that are longer in length. Thus, the board platen 100 can accommodate a variety of board sizes.

In one embodiment, the board reception plate 125 may have a size extension plate (not shown) coupled to a back end of the board reception plate 125. The size extension plate coupled to the back end of the board reception plate 125 would also slide bidirectionally as indicated by reference arrow 124. In such an embodiment, the size extension plate 112 and the size extension plate coupled to the back end would accommodate articles having an even longer length, because the board reception plate 125 coupled be extended in two directions, as opposed to just one.

The size extension plate 112 further comprises a plurality of alignment pins 113 that protrude from a top surface of the size extension plate 112. The "top surface" is that surface of the size extension plate 112 that interfaces with the article being installed on the platen 100 for printing, and it is the surface of the size extension plate 112 that is visible in FIG. 1. The alignment pins 113 are positioned and arranged to be received by one or more openings in the article being printed. As an example, a skateboard (not shown) comprises a plurality of openings to which screws on a truck are coupled to retain the truck on the skateboard. Thus, when the article (not shown) is placed on the platen 100, the pins 113 are inserted within the openings, which assists in self-alignment described further herein.

Figure 5:
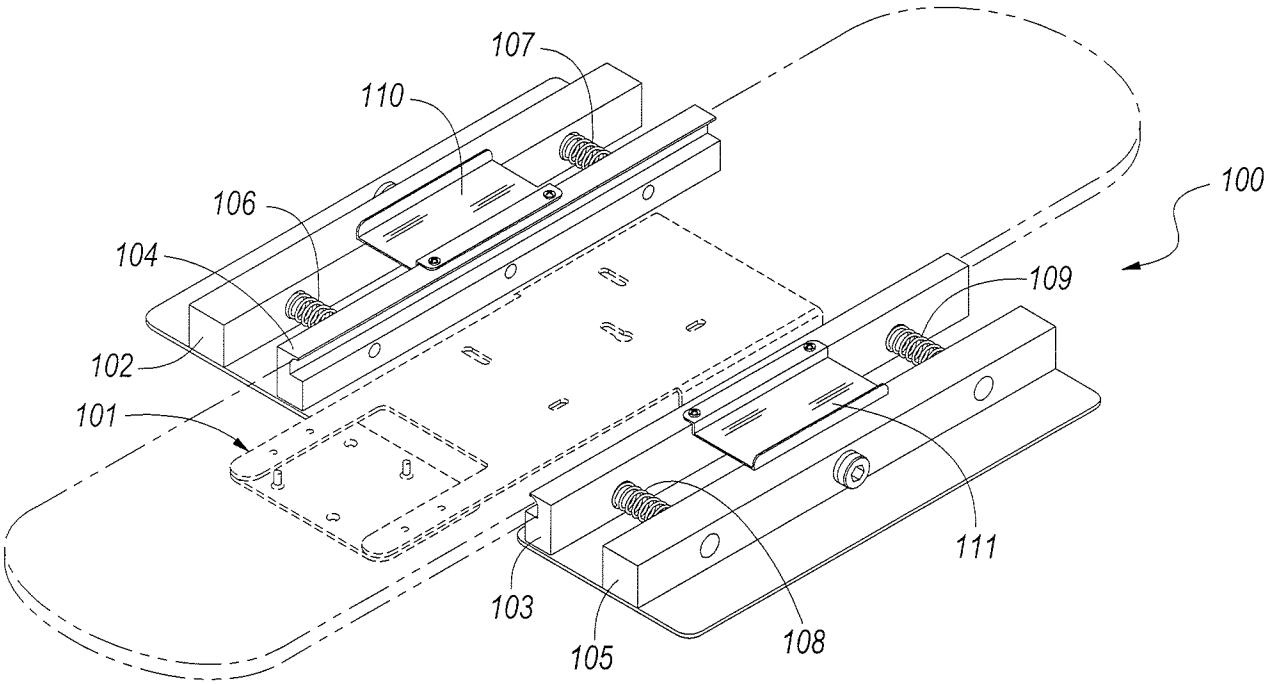
FIG. 5 is a top perspective view of the board platen showing a board being secured for printing.

The side plate 114 is rectangular in shape and is coupled to a fixed bar 105 and a sliding bar 103. The fixed bar 105 is a rectangular parallelepiped that is fixedly coupled to the side plate 114. The sliding bar 103 is substantially a rectangular parallelepiped similar to the fixed bar 105; however, the sliding bar 103 comprises a channel 122 for receiving an edge of a board, which is depicted in FIG. 5.

The fixed bar 105 and the sliding bar 103 are coupled together via springs 108 and 109. In one embodiment, the springs 108 and 109 are fixedly coupled to one or both of the fixed bar 105 and the sliding bar 103. Note that two springs 108 and 109 are depicted as coupling the fixed bar 105 to the sliding bar 103. However, use of two springs 108 and 109 is for exemplary purposes. The fixed bar 105 and the sliding bar 103 may be coupled together with fewer or more springs in other embodiments.

The side plate 114 further comprises a guide plate 111. In the embodiment depicted, the guide plate 111 is rectangular in shape. The guide plate 111 comprises a leading edge 117 and a following edge 116. The following edge 116 is fixedly coupled to the sliding bar 103 via fasteners, e.g., screws. However, the leading edge 117 is free allowing the guide plate 111 to move over a top surface 120 of the fixed bar 105. The leading edge 117 frictionally contacts the top surface 120 as the leading edge 117 moves over the top surface 120.

Note that the sliding bar 103 is spring-loaded relative to the fixed bar 105. Thus, the sliding bar 103 moves in a direction indicated by reference arrow 126 when a force is applied to the channeled side of the sliding bar 103. In this regard, when a board (not shown) is being installed on the board platen 100, an edge of the board is inserted into the channel 122. When the board is inserted into the channel 122, the force exerted by such insertion pushes the sliding bar 103 in the direction indicated by the reference arrow 126. As the sliding bar 103 slides in such direction, the guide plate 111 that is fixedly coupled to the sliding bar 103 causes a downward force on the sliding bar 103 thus guiding the sliding bar 103 and keeping it aligned and moving in the direction indicated by the reference arrow 126.

The side plate 115 is rectangular in shape and is coupled to a fixed bar 102 and a sliding bar 103. The fixed bar 102 is a rectangular parallelepiped that is fixedly coupled to the side plate 115. The sliding bar 104 is substantially a rectangular parallelepiped similar to the fixed bar 102; however, the sliding bar 104 comprises a channel 123 for receiving an edge of a board, which is depicted in FIG. 5.

The fixed bar 102 and the sliding bar 104 are coupled together via springs 106 and 107. In one embodiment, the springs 106 and 107 are fixedly coupled to one or both of the fixed bar 102 and the sliding bar 104. Note that two springs 106 and 107 are depicted as coupling the fixed bar 102 to the sliding bar 104. However, use of two springs 106 and 107 is for exemplary purposes. The fixed bar 102 and the sliding bar 104 may be coupled together with fewer or more springs in other embodiments.

The side plate 115 further comprises a guide plate 110. In the embodiment depicted, the guide plate 110 is rectangular in shape. The guide plate 110 comprises a leading edge 119 and a following edge 118. The following edge 118 is fixedly coupled to the sliding bar 104 via fasteners, e.g., screws. However, the leading edge 119 is free allowing the guide plate 110 to move over a top surface 121 of the fixed bar 102. The leading edge 119 frictionally contacts the top surface 121 as the leading edge 119 moves over the top surface 121.

Note that the sliding bar 104 is spring-loaded relative to the fixed bar 102. Thus, the sliding bar 104 moves in a direction indicated by reference arrow 127 when a force is applied to the channeled side of the sliding bar 104. In this regard, when a board (not shown) is being installed on the board platen 100, an edge of the board is inserted into the channel 123. When the board is inserted into the channel 123, the force exerted by such insertion pushes the sliding bar 104 in the direction indicated by the reference arrow 127. As the sliding bar 104 slides in such direction, the guide plate 110 that is fixedly coupled to the sliding bar 104 causes a downward force on the sliding bar 104 thus guiding the sliding bar 104 and keeping it aligned and moving in the direction indicated by the reference arrow 127.

As indicated hereinabove the alignment pins 113 are received by openings in an article that is being installed on the platen 100 for printing. The example provided herein is a skateboard and the openings that receive screws for coupling a truck to the skateboard. However, opening on other articles may receive the alignment pins 113 as well. In operation, the alignment pins 113 are inserted in the openings on the article being printed. The sliding bars 103 and 104 are slid in the directions indicated by reference arrows 126 and 127, respectively. When the sliding bars 103 and 104 are released when the article is in place on the plate 125, the alignment pins 113 hold the article stationary while the force of the sliding bars 103 and 104 on the article align the article in the platen 100 for printing. Thus, the platen 100 is self-aligning.

Figure 2:
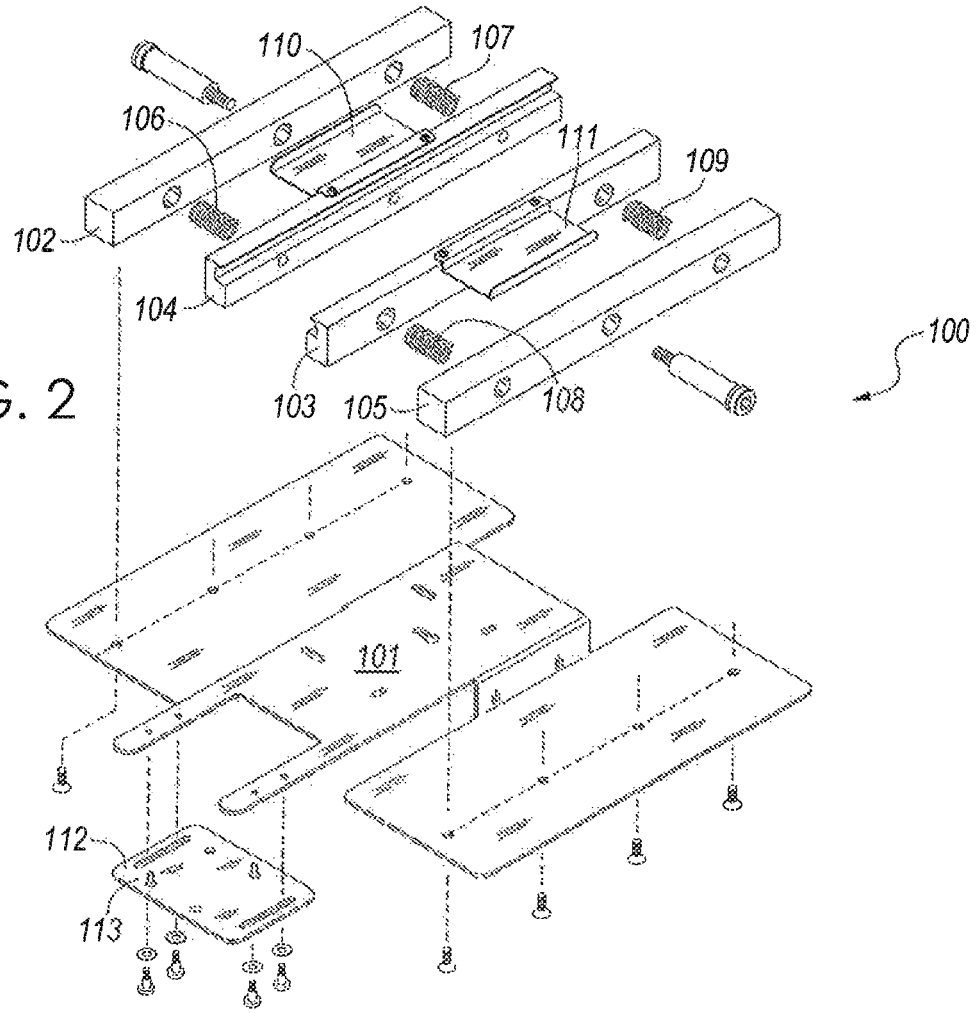
FIG. 2 is an exploded view of the board platen of FIG. 1.

FIG. 2 depicts an exploded view of the board platen 100 thus exposing in more detail the various components of the board platen 100. The board support plate 101 comprises three integral plates, including the board reception plate 125 and the two side plates 114 and 115. While the board reception plate 125 and the two side plates 114 and 115 are shown as integral plates creating a unitary board support plate 101, in other embodiments, the plates 125, 114, and 115 may be separate components that are fixed together via fasteners.

The board reception plate 125 is substantially rectangular and receives a board on which a user desires to print. In this regard, the board being printed on is installed adjacent the board reception plate 125.

The board reception plate 125 comprises two arms 203 and 204 extending therefrom for receiving the size extension plate 112. In this regard, the size extension plate 112 comprises slots 205 and 206 for slidably receiving fasteners 207. Thus, the size extension plate 112 may move bidirectionally as indicated by reference arrow 124 allowing the board support plate 101 to be extended to accommodate different lengths of boards.

As described hereinabove, the board reception plate 125 may couple to another size extension plate (not shown) on a back end of the board reception plate 125. In such an embodiment, the board reception plate 125 would further have arms (not shown) extending from the back end of the board reception plate 125 for receiving the additional size extension plate.

The side plates 114 and 115 are integral with and coupled to the board reception plate 125 via shoulders 210 and 211, respectively. Thus, when the sliding bars 103 and 104 are installed on the side plates 114 and 115, respectively, a portion of the sliding bars 103 and 104 are adjacent the shoulders 210 and 211. The position of the sliding bars 103 and 104 adjacent the shoulders 210 and 211 provide additional support for the sliding bars 103 and 104 when the sliding bars 103 and 104 are retaining a board (not shown).

Once the board platen 100 is assembled, as described hereinabove, the board platen 100 may be coupled to a printing apparatus (not shown). In one embodiment, the board platen 100 is coupled to the printing apparatus via an adapter, hereinafter referred to as a main plate, which is shown in FIGS. 3 and 4.

Figure 3:
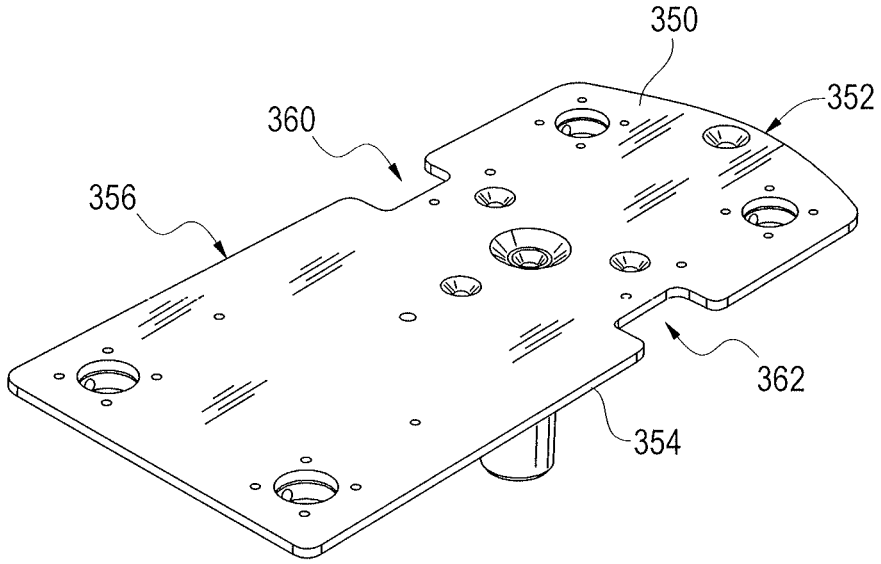
FIG. 3 is a top perspective view of an exemplary main plate in accordance with an embodiment of the present disclosure.

FIG. 3 is a top perspective view of a main plate 350 four coupling the board platen 100 to the printing apparatus. In the embodiment depicted, the main plate 350 is generally rectangular-shaped. However, the main plate 350 may be other shapes in other embodiments, and the disclosure does not limit the main plate 350 to a particular shape. The substantially rectangular shape is merely exemplary.

The main plate 350 comprises a rounded back edge 352, two side edges 354 and 356, and a front edge 358. In one embodiment, the side edges 354 and 356 comprise substantially rectangular slots 362 and 360, respectively. The rectangular slots 360 and 362 fit the main plate 350 to the printing apparatus.

Figure 4:
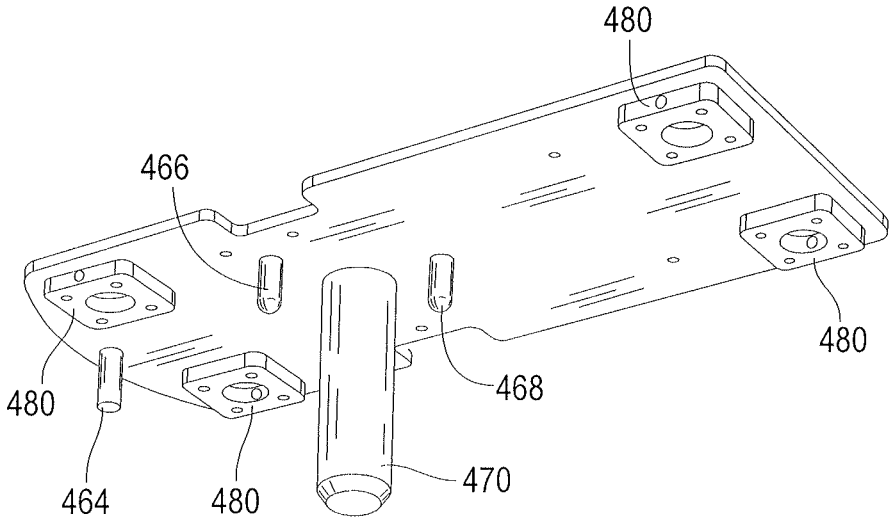
FIG. 4 is a bottom perspective view of the main plate of FIG. 3.

FIG. 4 is a bottom perspective view of the main plate 350. On a bottom surface 490 of the main plate 350 are a plurality of projections 464, 466, 468, and 470 extending away from the bottom surface 490. Note that there is an addition projection (not shown) that extends from the main plate 350 that is hidden behind projection 470. In the embodiment shown, the projections 464, 466, 468, 470, and the hidden projection couple the main plate 350 to the printing apparatus and align the main plate 350 relative to the printing apparatus.

To fix the board platen 100 to the main plate 350, the main plate 350 may comprise a securing peg or bot (not shown) that protrudes out from the top surface 380 (FIG. 3) of the main plate 350. This peg or bolt may be designed to fit into a corresponding hole in the board platen. To further assist in mounting the board platen 100 to the main plate 350, the main plate 350 may further comprise a series of magnets 480.

In the embodiment depicted, there are four such magnets 480 positioned at the corners of the bottom surface 490 of the main plate 350. Note that while four magnets are shown positioned at the corners of the bottom surface 490 of the main plate 350, the main plate 350 may comprise fewer or more magnets in other embodiments. Further, the magnets 480 may be positioned at other places on the bottom surface 490 instead of or in addition to being coupled to the four corners.

FIG. 5 depicts the board platen 100 on which a board 500 is installed. As indicated hereinabove, the board platen 100 may securely retain a variety of types of boards. For example, the board 500 may be a skateboard, a snowboard, or a surfboard. This list is not intended to be limiting. In this regard, other types of boards may be secured to the board platen 100 for printing in other embodiments.

To install the board 500 on the board platen 100, the sliding bars 103 and 104 are displaced, e.g., pushed, in directions indicated by reference arrows 501 and 502. In this regard, a force is applied in these directions to the sliding bars 103 and 104, and the sliding bars 103 and 104 slide outwardly so that edges 505 and 506 of the board 500 may be inserted into respective slots 122 and 123 of the sliding bars 103 and 104.

As the sliding bars 103 and 104 are pushed outward in the identified directions, the fixed bars 105 and 102 apply a resistive force through the springs 108, 109 and 106, 107 to the sliding bars 103 and 104 in a direction indicated by reference arrows 504 and 503, respectively. Thus, once the board 105 is inserted, the force applied by the fixed bars 105 and 102 to the springs 108, 109 and 106, 107 pushes, through the sliding bars 103 and 104, the edges 505 and 506 of the board. Notably, force is applied through the springs 108, 109 and 106, 107 to the sliding bars 103 and 104, which applies force to the edges 505 and 506 of the board 500 and retains the board 500 in the board platen 100.

As described hereinabove, the size extension plate 112 may be used to accommodate boards have varying length. FIG. 5 depicts the board platen 100 retaining a board of a size that is supported by the board support plate 101 when the size extension plate 112 is in a fully set position, i.e., it has not been slid outwardly in the direction indicated by a reference arrow 510. However, if additional support is needed, for example because the board being installed is longer than the board 500 shown in FIG. 5, the size extension plate 112 may be slid in the direction indicated by reference arrow 510 to provide support to the longer board.

Figure 6:
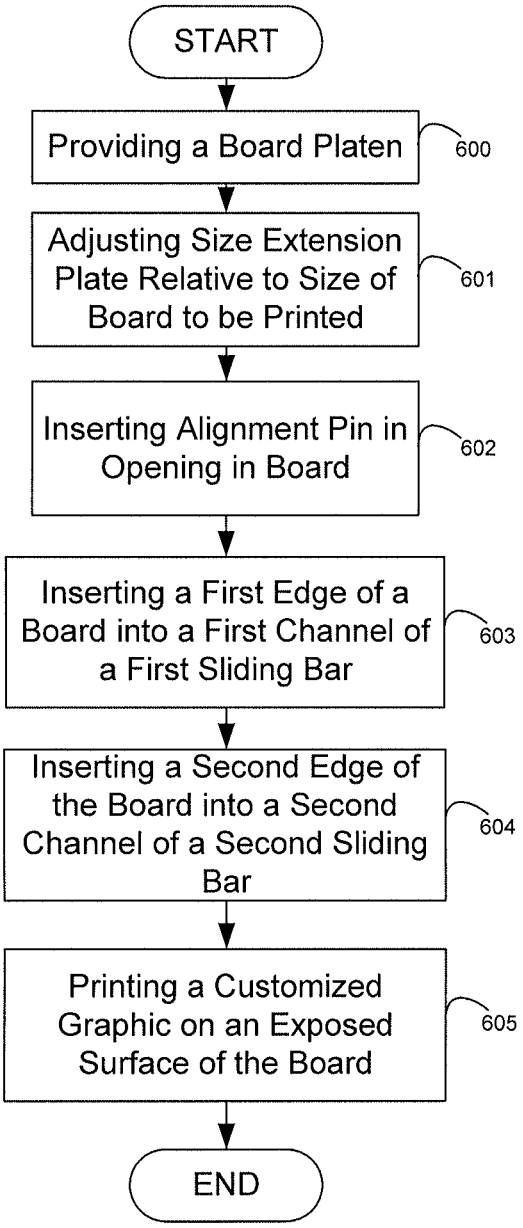
FIG. 6 is a flowchart of an exemplary method in accordance with an embodiment of the present disclosure.

FIG. 6 depicts an exemplary method in accordance with an embodiment of the present disclosure. The method comprises the step of providing a board platen at 600. In one embodiment, the board platen has a board reception plate coupled on a first side to a first side plate and coupled on a second side to a second side plate, which is adapted for supporting a board. Additionally, the board platen has a first spring-loaded sliding bar coupled to the first side plate that has a first channel for receiving a first edge of the board and a second spring-loaded sliding bar coupled to the second side plate that has a second channel for receiving a second edge of the board.

The method further comprises adjusting the size extension plate 112 (FIG. 1) relative to the size of a board to be printed in step 601. In step 602, the alignment pin 113 (FIG. 1) is inserted into an opening in the board.

The method further comprises inserting a first edge of the board into the first channel of the first sliding bar at 603. Note that in one embodiment, when the first edge of the board is inserted into the first channel of the first spring-loaded bar, the first spring-loaded bar slides relative to the reception board toward a first fixed bar that transfers force through at least one spring to the spring-loaded bar.

The method further comprises inserting a second edge of the board into the second channel of the second sliding bar at 604. Note that in one embodiment, when the second edge of the hoard is inserted into the second channel of the second spring-loaded bar, the second spring-loaded bar slides relative to the reception board toward a second fixed bar that transfers force through at least one spring to the spring-loaded bar.

Finally, the method further comprises printing a customized graphic on an exposed surface of the board in step 605. Note that as described herein, the present disclosure contemplates a main plate that is adapted for coupling to a printing apparatus. The main plate is an adapter that couples board platen to the printing apparatus. The board platen retains and secures boards, for example skateboards, snowboards, surfboards, and/or the like to the printing apparatus so that graphics can be printed on the board.

What is claimed is:

1. A device, comprising:

a board reception plate coupled on a first side to a first side plate and coupled on a second side to a second side plate, the board reception plate comprising an alignment pin for receiving an opening in an underside of a board, said board reception plate adapted for supporting the board;

a first spring-loaded sliding bar coupled to the first side plate, the first spring-loaded sliding bar comprising a first channel for receiving a first edge of the board;

a second spring-loaded sliding bar coupled to the second side plate, the second spring-loaded sliding bar comprising a second channel for receiving a second edge of the board.

2. The device of claim 1, wherein the board reception plate is integral with the first side plate and the second side plate thereby forming a unitary board support plate.

3. The device of claim 1, wherein the board reception plate, the first side plate, and the second side plate are separate components coupled together via fasteners.

4. The device of claim 1, wherein the board reception plate comprises a size extension plate slidably coupled to a front end of the board reception plate.

5. The device of claim 4, wherein the board reception plate comprises a first arm and a second arm.

6. The device of claim 5, wherein the first arm and the second arm are coupled to a first slot and a second slot on the size extension plate for sliding the size extension plate relative to the board reception plate thereby extending the board reception plate for accommodating different sizes of boards.

7. The device of claim 1, further comprising a first fixed bar fixedly coupled to the first side plate and coupled via at least one first spring to the first sliding bar.

8. The device of claim 7, further comprising a second fixed bar fixedly coupled to the second side plate and coupled via at least one second spring to the second sliding bar.

9. The device of claim 8, wherein the first fixed bar and the second fixed bar push the first sliding bar and the second sliding bar, respectively, to the first edge and the second edge of the board thereby retaining the board relative to the board reception plate.

10. The device of claim 8, further comprising:

a first guide plate fixedly coupled to the first sliding bar and slidably interfaced with the first fixed bar; and a second guide plate fixedly coupled to the second sliding bar and slidably interfaced with the second fixed bar.

* * * * *